United States Patent [19]

Beson

[11] Patent Number: 4,569,540

[45] Date of Patent: Feb. 11, 1986

[54] PIPING SUSPENDER WITH METAL-TO-METAL SEAL

[75] Inventor: John Beson, Houston, Tex.

[73] Assignee: Beson Technology, Inc., Houston, Tex.

[21] Appl. No.: 566,564

[22] Filed: Dec. 29, 1983

[51] Int. Cl.[4] ..... F16L 35/00

[52] U.S. Cl. ..... 285/93; 285/139; 285/142; 285/341; 285/351

[58] Field of Search ..... 285/93, 139, 140, 142, 285/143, 341, 347, 351, 334.2, DIG. 18, DIG. 11; 166/88, 87

[56] References Cited

U.S. PATENT DOCUMENTS

| | | | |
|---|---|---|---|
| 3,025,083 | 3/1962 | Lebeaux | 285/142 |
| 3,080,180 | 3/1963 | Rector | 285/140 |
| 3,151,680 | 10/1964 | Parkhurst | 285/140 |
| 3,526,418 | 9/1970 | Barnett | 285/93 |
| 4,056,272 | 11/1977 | Morrill | 285/140 |
| 4,109,942 | 8/1978 | Morrill | 285/140 |
| 4,381,868 | 5/1983 | Croy et al. | 285/142 |
| 4,455,040 | 6/1984 | Shinn | 285/142 |

OTHER PUBLICATIONS

Product Engineering Annual Handbook 1955, Hydraulic & Pneumatic Equipment, p. J33.

*Primary Examiner*—Cornelius J. Husar
*Assistant Examiner*—Eric K. Nicholson
*Attorney, Agent, or Firm*—Arnold, White & Durkee

[57] ABSTRACT

A piping suspender with a metal-to-metal seal includes a piping hanger with an annular extension received in a counterbore of a well head and confined by a head adapter. The extension includes upwardly and downwardly facing, generally horizontally disposed shoulders. The upwardly facing shoulder abuts with the lower face of the head adapter and the downwardly facing shoulder abuts with an annular, generally horizontally disposed shoulder on the well head, to sealingly support the piping hanger and connected piping on the well head and to seal the hanger with respect to the adapter. A set of test lines are provided to enable seal testing.

17 Claims, 2 Drawing Figures

Fig 1
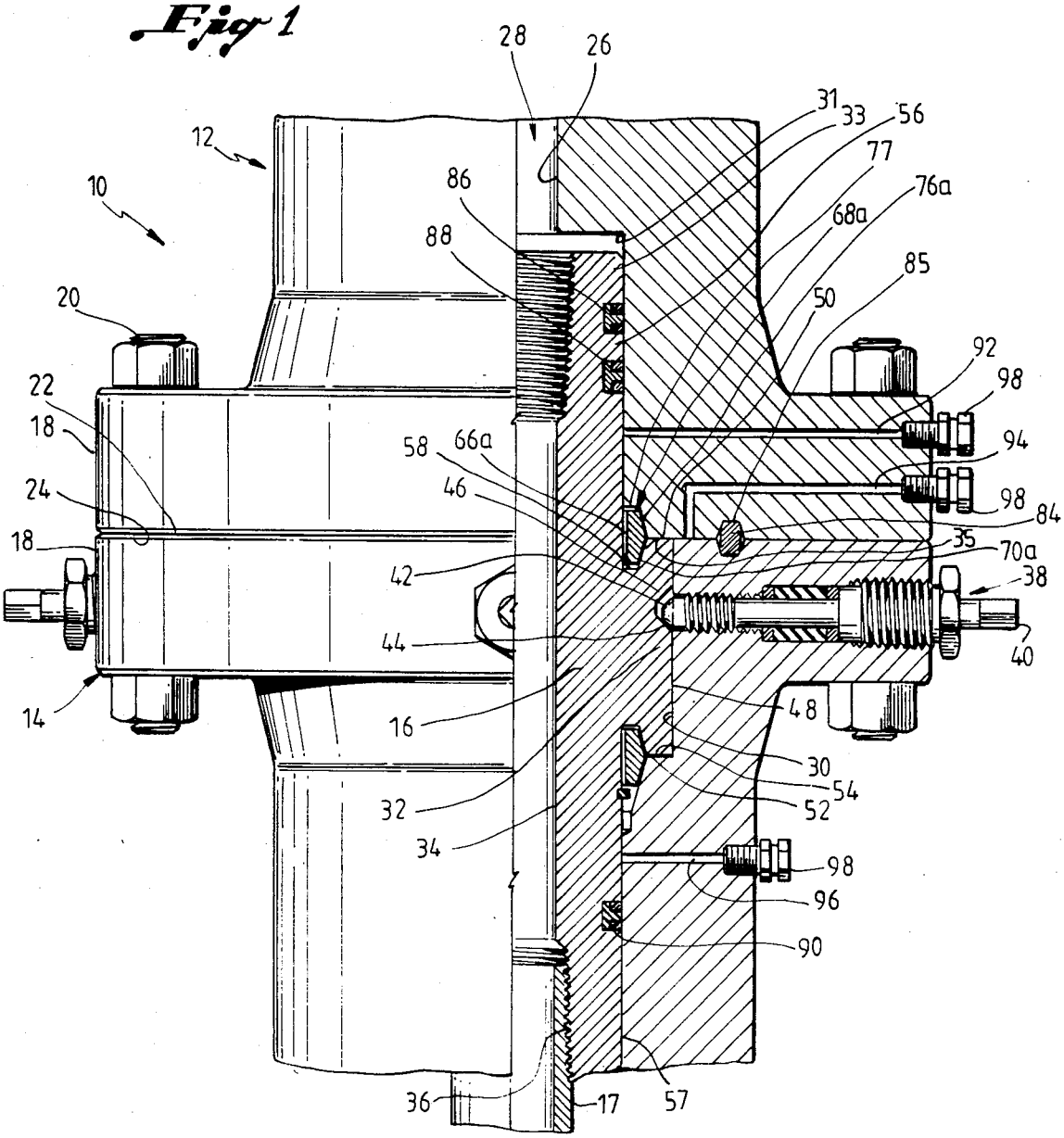
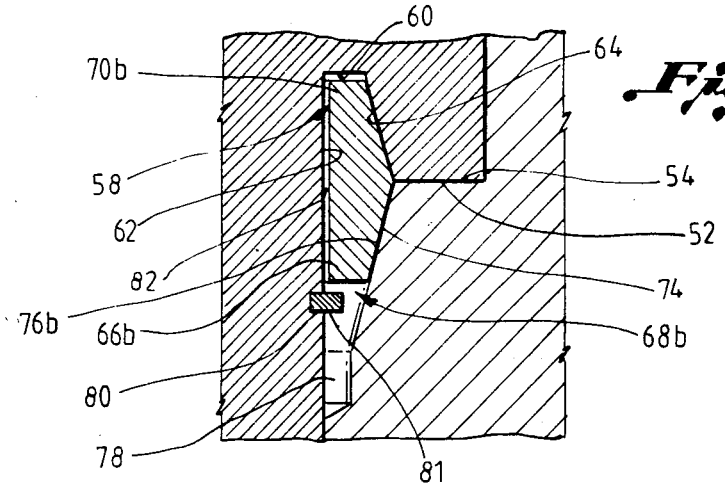
Fig. 2

PIPING SUSPENDER WITH METAL-TO-METAL SEAL

BACKGROUND OF THE INVENTION

1. Field of the Invention

This invention relates generally to piping hangers for wells and specifically to seals for piping hangers.

2. Brief Description of the Background Art

U.S. Pat. Nos. 4,109,942 and 4,056,272, both issued to Morrill, disclose tubing hangers with seal arrangements designed to contain downhole well pressures. These patents disclose metal-to-metal seals with a frustoconical metal gasket between the tubing hanger and the wellhead and an "x" cross sectional resilient metal gasket between the hanger and the christmas tree.

While the design illustrated in these patents has many advantages, due to tolerance problems arising in part from the frustoconical arrangement of the sealing surfaces, a less than ideal seal is achieved. Moreover, the arrangement illustrated requires a relatively large number of seal members.

SUMMARY OF THE INVENTION

It is the primary object of the present invention to provide a piping suspender in which a metal-to-metal seal is achieved between a piping hanger and a well head which minimizes the number of seal members required and which provides an accurately controllable metal-to-metal seal.

These and other objects of the present invention are achieved by a piping suspender with a well head having an axial bore, and a piping hanger. The hanger is mountable within the well head bore. The hanger and the well head each include a shoulder oriented generally transversely with respect to the length of the bore. The shoulders are arranged in opposition to sealingly abut with one another. A seal member is positioned between the piping hanger and the well head adjacent the shoulders.

In accordance with another embodiment of the present invention, a piping suspender includes a well head having an upper surface and a piping head adapter releasably connectable to the upper surface of the well head. A piping hanger bore extends through the piping head adapter and well head. The bore includes a reduced diameter section in the head adapter spaced from the well head and an enlarged diameter section in the well head adjacent the piping head adapter. The well head includes a generally horizontally disposed land defined by the end of the enlarged diameter section. A piping hanger, mountable within the bore, includes an annular extension sized to be received within the enlarged diameter section. The annular extension has upwardly and downwardly facing, generally horizontally oriented shoulders. The upwardly facing shoulder is arranged in sealing abutment with the head adapter and the downwardly facing shoulder is arranged in sealing abutment with the land. A pair of annular seal passages are provided, one positioned between the hanger and the head adapter and the other positioned between the hanger and the well head. A pair of annular seals are positioned one in each seal passage.

BRIEF DESCRIPTION OF THE DRAWING

FIG. 1 is a partial, partially sectioned front elevational view of one embodiment of the present invention; and FIG. 2 is an enlarged cross-sectonal view of a portion of the embodiment shown in FIG. 1.

DESCRIPTION OF THE PREFERRED EMBODIMENT

Referring to the drawing wherein like reference characters are used for like parts throughout the several views, a piping suspender 10, shown in FIG. 1, includes a head adapter 12, a well head 14, and a piping hanger 16. The term "adapter", as used herein, can include a connector for connecting the Christmas tree (not shown) to the well head 14 or the Christmas tree itself. The term "piping" as used herein may include tubing or casing. The head adapter 12 and head 14 may include flanges 18 connectable by bolts 20 to sealingly abut the upper face 22 of the head 14 against the face 24 of the head adapter 12. The adapter 12 and head 14 have an axial bore 26 which defines a central opening 28 capable of receiving the piping hanger 16.

The head 14 includes a counterbore 30 which receives an annular extension or flange 32 of the piping hanger 16. The interior of the pipe hanger 16 also includes a bore 34 with a threaded end 36 to enable the hanger 16 to connect to a conventional well tubing string 17. The adapter 12 may include a counterbore 31 to receive and contain the upper extension 33 of the hanger 16. The diameter of the counterbore 30 is advantageously greater than the diameter of the counterbore 31, so that a portion of the face 24 forms the overhang or shoulder 35.

The hanger 16 is positioned within the counterbore 30 by the lockscrews 38 which thread through the head 14 and are adjustable by the spindle 40 positioned on the exterior of the head 14. The beveled ends 42 of the lockscrews 38 mate with the lower edges 44 of countersinks 46 formed in the lateral side 48 of the annular extension 32. The juxtaposition of a beveled end 42 and lower edge 44 provides a wedging action to downwardly displace the piping hanger 16 upon insertion of the lockscrew 38.

The axial length of the counterbore 30 corresponds precisely to the length of the annular flange 32 so that when the piping hanger 16 is positioned in sealing arrangement within the bore 26, the face 24 of the adapter 12 is flush against the face 22 of the head 14. Moreover the generally transversely arranged upper shoulder 50 of the extension 32 may be abutted flush against the face 24 while the generally transversely arranged lower shoulder 52 of the extension 32 is positioned flush upon the annular land 54 defined in the head 14 by the counterbore 30.

The annular extension 32 has recesses 58 located just radially inwardly of the lateral side 48 and each shoulder 50 or 52, and in line with the adjacent outer surface 56 or 57 of the pipe hanger 16. The recesses 58 each include a generally transversely oriented end wall 60, an axially oriented inner wall 62 and a countersunk outer wall 64, as shown in FIG. 2. The recesses **66*a* and 66*b*, the mirror images of the recesses 58, are formed adjacent each recess 58. The combinations of the opposed recesses 58 and 66 create the seal passages 68*a* and 68*b* which receive the annular seals 70*a* and 70*b*. The annular seals 70, in the illustrated embodiment, viewed crosssectionally, have tapered, radially outwardly directed sealing faces 74**.

Adjacent to each shoulder 50 or 52, is a chamfered surface 76 which forms a wall of each seal passage 68. In the case of the upper shoulder 50, the associated chamfered surface 76*a* tapers upwardly and inwardly away from the shoulder 50. In the case of the lower shoulder 52, a chamfered surface 76*b* tapers inwardly and downwardly from the shoulder 52. The chamfered surfaces 76, together with the horizontal walls 77 and inner walls 62, create the remainder of each seal passage 68 that conforms generally to and receives an annular seal 70. In addition, an indentation 78 is formed adjacent the base of the chamfered surface 76*b*. This allows for the inclusion of a bowl protector (not shown) which may be positioned over the seal surfaces including the land 54 and the chamfered surface 76*b*, to protect those surfaces when well tools are inserted and withdrawn from the well, with the piping hanger 16 removed.

While the annular seals 70 may take a variety of forms, they are generally made of a ring of relatively soft metal whose diameter is slightly greater than the diameter of the seal passages 68 so that the sealing face 74 is pressed against the outer walls 64 and chamfered surfaces 76 of the sealing passages 68. A variety of metal, pressure energized seal rings, such as the commercial "R-CON", or "Graloc" seals may be utilized as the seals 70. Conveniently the seals 70 are retained within the seal passages 68 by the retainer ring 81, which fits into an aperture 80 in the tubing hanger 16. Because of the initially greater diameter of the seals 70 with respect to the seal passages 68, a passageway 82 is defined along the non-sealing walls 60, 62, and 77.

To provide an adequate seal between the faces 22 and 24, a seal ring 84 is located in a groove 85 in each of the faces 22 and 24 at a position intermediately between the outside of the head 14 and the hanger 16. The seal 84 may take a variety of forms, including that of a conventional BX seal. Similarly, the seals 86 are located between the upper extension 33 of the piping hanger 16 and the adapter 12, above the seal 70*a*. The seals 86 advantageously take the form of T-seals with their prongs 88 extending from the pipe hanger 16 towards abutment with the bore 26 of the adapter 12. While two seals 86 are shown in the illustrated embodiment, one or more such seals are normally adequate for the present purposes. In similar fashion at least one seal 90 is located below the seal 70*b*, between the piping hanger 16 and the head 14. The seal 90 may be a T-seal as illustrated or an O-ring with back up rings.

A plurality of seal test lines 92, 94 and 96 extend to the exterior of the head 14 and adapter 12. The line 92 extends from a point adjacent the juncture of the hanger 16 and adapter 12, below the seals 86, to an external connector 98. The line 94 extends from the joint between the head 14 and adapter 12 and in between the hanger 16 and seal 84 to an external connector 98. Finally, the test line 96 extends from a point below the lower annular seal 70*b* and above the seal 90, to an external connector 98. When no tests are being run, each of the connectors 98 may be closed to prevent leakage. A source of pressure or vacuum may be connected to each of the connectors 98 in order to test the functioning of the seals 70, 84, 86, and 90.

The operation of the suspender 10 may be generally along the following lines. Initially, with the adapter 12 disconnected from the head 14, the piping hanger 16 with the string 17 connected, is positioned within the bore 26 of the head 14. This is done with the lockscrews 38 withdrawn from the counterbore 30 so that the annular extension 32 is positioned with its lower edge 52 spaced slightly from the land 54. This spacing is due to the presence of the adjacent annular seal 70*b* which presses against the outer wall 64 of the recess 58 and the chamfered surface 76. Often the weight of the tubing string 17 is sufficient to cause the lower shoulder 52 to meet and abut sealingly against the land 54 such that the annular seal 70*b* seals against the adjacent faces of the extension 32 and chamfered surface 76. If this is not the case, the lockscrews 38 are adjusted inwardly to wedge the piping hanger 16 downwardly until the malleable annular seal 70*b* is compressed sufficiently to provide metal-to-metal sealing contact between the shoulder 52 and the land 54.

With the seal 84 in position in the grooves 85, the adapter 12 is bolted by way of bolts 20 and flanges 18 onto the head 14 so that the seal 84 provides a good seal between the abutting faces 22 and 24. The bolts 20 are tightened until a good metal-to-metal seal is achieved between both the faces 22 and 24 and the shoulder 50 of the extension 32 and the face 24 of the adapter 12. At the same time the upper seal 70*b* is also sealingly pressed against the chamfered surface 76 and outer wall 64 to create a pressure energized seal at the juncture.

The use of generally transversely arranged, opposed sealing surfaces 50 and 35, and 52 and 54 enables an extremely effective seal to be achieved in part because the square shoulders permit closer tolerancing than conventional frustoconical sealing surfaces.

The lower seal 70*b* and the seal 90 may be tested, before the blowout preventers (not shown) are removed, by pressurizing the line 96 to a level above working pressure, conveniently 1000 psi above working pressure. The pressure energizes the seals 70*b* and 90, as described previously, and enables the operation of the seals to be tested and if necessary corrected before the blowout preventers are removed. After the head adapter 12 is installed, the upper annular seal 70*b* and the seal 86 are tested by pressurizing the upper seal test line 92 to working pressure plus 1000 psi while leaving the line 94 open. With the lines 92 and 96 at 1000 psi above working pressure, the test line 94 is then pressurized to working pressure to test the seal 84. Finally the pressure is diminished in lines 94, 96, and 92, in that order.

While the present invention has been described with respect to a single preferred embodiment, those skilled in the art will appreciate a number of variations and modifications and it is intended within the appended claims to cover all such variations and modifications as come within the true spirit and scope of the present invention.

I claim:

1. A piping suspender comprising:

a well head with an axial bore;

a piping hanger mountable within said well head bore;

each of said hanger and said head including a shoulder oriented generally transversely with respect to the length of said bore, said shoulders arranged in opposition to sealingly abut with one another and to support said hanger on said well head;

a seal member including a first ring seal positioned between said piping hanger and said head adjacent said shoulders, said piping hanger including a recess for receiving said first ring seal; and said shoulder of said well head having a chamfered edge, said chamfered edge and said recess in said piping hanger together forming a seal passage for receiving said first ring seal.

2. The suspender of claim 1 wherein said shoulder of said head has a chamfered edge.

3. The suspender of claim 1 wherein said hanger includes an annular extension, said extension defining an abutment and said piping hanger shoulder, said suspender further including a head adapter sealingly connectable to said well head over said hanger, said head adapter having a generally horizontal lower face, said abutment being adapted to abut with the lower face of said head adapter.

4. A suspender of claim 3 wherein said piping suspender includes a second ring seal sealingly associated with said abutment.

5. The suspender of claim 4 including a first annular seal positioned between said piping hanger and said head adapter, above said second ring seal, and a second annular seal positioned between said piping hanger and said well head, below said first ring seal.

6. The suspender of claim 5 including a plurality of seal test lines.

7. The suspender of claim 6 including a test line connected to the exterior of said head on one end and connected on the other end to the juncture of said head and said piping hanger between said second annular seal and said first ring seal.

8. The suspender of claim 4 wherein said piping hanger includes recesses for receiving said ring seals.

9. The suspender of claim 8 wherein said ring seals include tapered exterior sealing edges and the said ring seals being in a radially compressed condition.

10. A piping suspender comprising:

a well head having an upper surface;

a head adapter releasably connectable to said upper surface of said well head;

a piping hanger bore extending through said head adapter and said well head, said bore including an enlarged diameter section in said well head extending downwardly from said upper surface, said well head including a generally horizontally disposed land defined by the innermost end of said enlarged diameter section;

a piping hanger mountable within said bore, said hanger including an annular extension sized to be received within said enlarged diameter section;

said annular extension including upwardly and downwardly facing, generally horizontally oriented shoulders, said upwardly facing shoulder being arranged in sealing abutment with said head adapter and said downwardly facing shoulder being arranged in sealing abutment with said land;

a pair of annular seal passages, one positioned between said piping hanger and said head adapter and the other positioned between said piping hanger and said well head;

a pair of annular seals, one positioned in each of said seal passages, said annular seals being positioned in juxtaposition to said shoulders; and a first chamfered surface in said head adapter adjacent to one of said shoulders, and a second chamfered surface in said well head adjacent to the other of said shoulders, said annular seals each abutting against one of said chamfered surfaces.

11. The suspender of claim 10 wherein said seals are pressure energized ring seals, in a radially compressed condition.

12. The suspender of claim 10 including a first seal between said piping hanger and said head adapter, at a point spaced from said upper surface of a said well head, and a second seal between said piping hanger and said well head, below said enlarged diameter section.

13. The suspender of claim 12 wherein said first and second seals are T-seals.

14. The suspender of claim 10 wherein said seal passages extend into said annular extension.

15. The suspender of claim 14 wherein said annular seals include radially outwardly facing surfaces that taper to a point at the adjacent shoulder.

16. The suspender of claim 10 including means for testing said seals.

17. The suspender of claim. 16 wherein said testing means includes a set of three test lines, each extending from a point on the exterior of said suspender to a point in fluid communication with one of said seals, a first of said lines being above said seals, a second line being below said seals and a third line being between said seals.

* * * * *